US006146177A

United States Patent [19]

Wu

[11] Patent Number: 6,146,177

[45] Date of Patent: Nov. 14, 2000

[54] ELECTRICAL CONNECTOR HAVING A LOCKING DEVICE

[75] Inventor: Jerry Wu, Chang-Hua Hsien, Taiwan

[73] Assignee: Hon Hai Precision Ind. Co., Ltd., Taipei Hsien, Taiwan

[21] Appl. No.: 09/221,274

[22] Filed: Dec. 23, 1998

[30] Foreign Application Priority Data

Feb. 17, 1998 [TW] Taiwan ..... 87202309

[51] Int. Cl.[7] ..... H01R 13/62

[52] U.S. Cl. ..... 439/326

[58] Field of Search ..... 439/326, 327, 439/328, 637

[56] References Cited

U.S. PATENT DOCUMENTS 5,755,585 5/1998 Cheng et al. ..... 439/326

5,938,463 8/1999 Yodogawa ..... 439/326

*Primary Examiner*—Brian Sircus
*Assistant Examiner*—Chandrika Prasad

[57] ABSTRACT

An electrical connector having a locking device comprises a dielectric housing having a mating face and a connecting face. A pair of locking devices are assembled to ends of the housing and define a receiving space with the housing. Each locking device includes a locking arm connected to each end of the housing. A supporting arm is connected to the same end of the housing and defines a retaining slot therein. A retaining embossment extends from an inner wall of the locking arm toward the receiving space for retaining an inserted card. And a releasing device is assembled to each locking device for releasing the inserted card therefrom. The releasing device includes a base and a resilient arm extending from a side of the base. A U-shaped enclosure is formed on an end of the resilient arm for enveloping a free end of the resilient arm, and a foot extending from the base is received within the retaining slot of the supporting arm.

4 Claims, 6 Drawing Sheets

ELECTRICAL CONNECTOR HAVING A LOCKING DEVICE

FIELD OF THE INVENTION

The present invention relates to an electrical connector, and more particularly to an electrical connector having a locking device for facilitating engagement and disengagement with an inserted electrical module.

DESCRIPTION OF PRIOR ART

In order to facilitate easy insertion of a memory module to a memory-module connector, the connector is configured so that during insertion of the module, the module encounters an interference force. Then after the module is seated and rotated through a given angle, the module is connected to the connector benefiting an lower overall height of the module after insertion. Furthermore, the connector is provided with a locking device to securely hold the module in position to ensure a reliable electrical connection therebetween. Additionally, the connector is also provided with a positioning device to accurately hold the connector on a printed circuit board on which the connector is mounted during a soldering process.

Conventionally, the locking device used with a conventional module connector is made from plastic material and is integrally molded with a housing of the connector, however, the plastic locking device has poor retention capability. Accordingly, a metal locking device is provided to increase the resilient capability. Even the metal locking device has superior retention force than the plastic locking device, an edge of the memory module can be easily damaged by the rigidity of the metal locking device. Furthermore, the cost of the metal locking device is also expensive. U.S. Pat. No. 5,383,792 discloses a typical module connector.

A composite locking device made from plastic and metal material is therefore introduced to replace the locking device solely made from plastic or metal. Taiwan Utility Application Nos. 81102107, 84100813 and U.S. Pat. Nos. 4,986,765, 5,004,429, 5,632,640 disclose such connectors. This composite connector includes a retention embossment integrally formed with a housing of the connector. A releasing device made from metal material is assembled to the housing and can be actuated to neutralize the retention of the locking device thereby releasing the inserted memory module therefrom. However, the plastic retention embossment tends to be broken at a joint between the retention embossment and the releasing device because of stress concentration if an excess manipulating force is exerted thereon. Additionally, in order to prevent the retention embossment from breaking apart, a stopper extending from the housing is used to limit over-movement of the retention embossment. This adversely increases the length of the connector.

SUMMARY OF THE INVENTION

An objective of this invention is to provide an electrical connector having an improved locking device for securely retaining an inserted memory module.

According to one aspect of the present invention, the locking device is provided with a first stopper thereby limiting movement of a retention embossment.

According to another aspect of the present invention, the retention embossment is reinforced by a metal arm thereby increasing the resilient property thereof.

In order to achieve the objective set forth, an electrical connector having locking device comprises a dielectric housing having a mating face and a connecting face. A receiving slot is defined along the mating face and a plurality of terminals are assembled therein. A pair of locking devices are assembled to ends of the housing and define a receiving space with the housing. Each locking device includes a locking arm connected to each end of the housing. A supporting arm is connected to the same end of the housing and defines a retaining slot therein. A retaining embossment extends from an inner wall of the locking arm toward the receiving space for retaining an inserted card. And a releasing device is assembled to each locking device for releasing the inserted card from the locking devices. The releasing device includes a base and a resilient arm extending from a side of the base. A U-shaped enclosure is formed on an end of the resilient arm for enveloping a free end of the resilient arm and a foot extending from the base is received within the retaining slot of the supporting arm.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
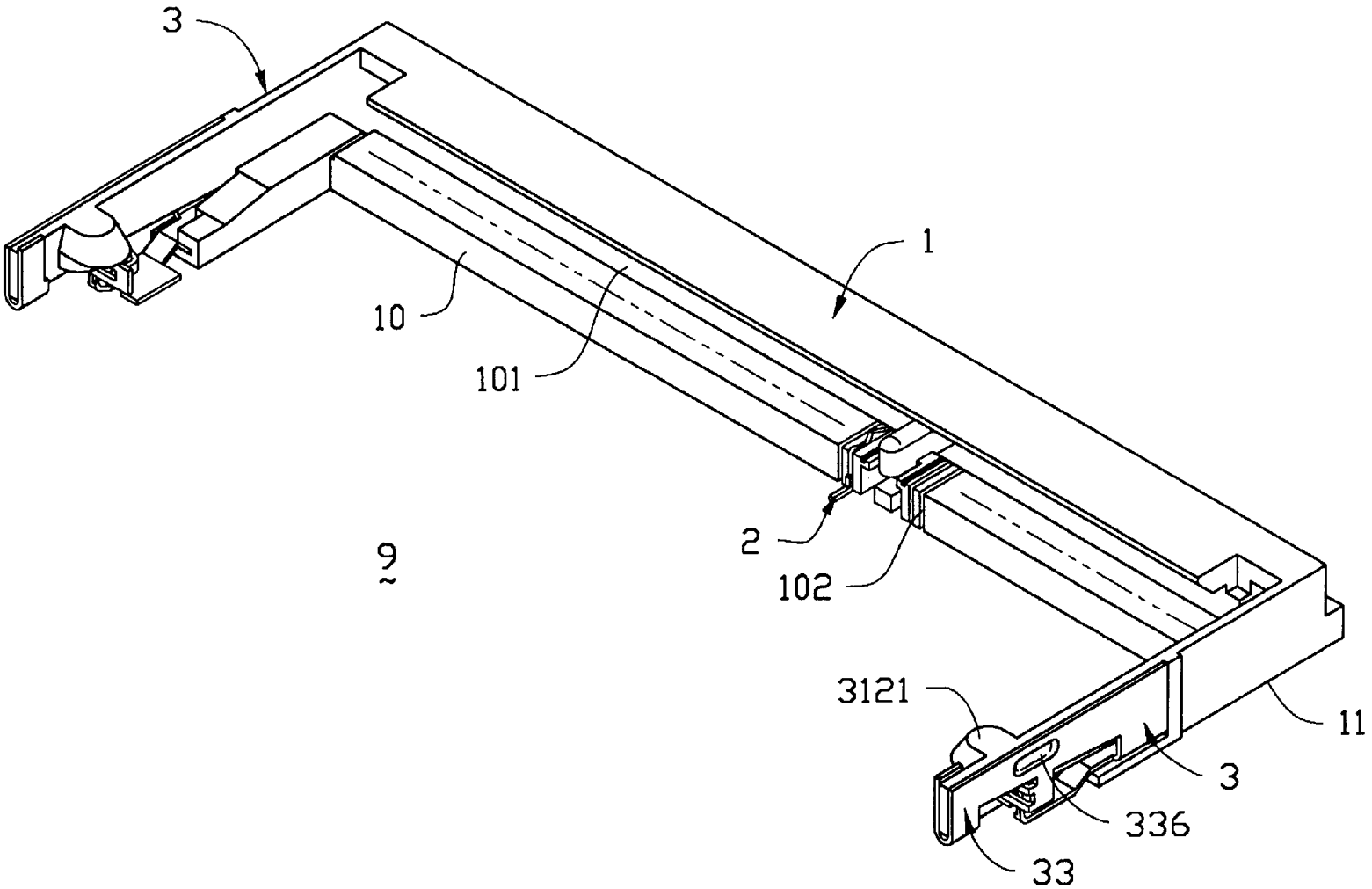
FIG. 1 is a perspective view of an electrical connector in accordance with the present invention.

Referring to FIG. 1, an electrical connector 9 having a locking device includes a dielectric housing 1, a plurality of terminals 2 assembled within the housing 1, and a pair of locking devices 3 assembled to the housing 1. The housing 1 has a rectangular configuration defining a mating face 10 and a connecting face 11. A receiving slot 101 is defined along the mating face 10 for receiving a card 4 (FIG. 5A) therein. The slot 101 defines a plurality of terminal cells 102 on sidewalls thereof each receiving a terminal 2 therein. The connector 9 is assembled to a motherboard (not shown) by means of the connecting face 11. The locking devices 3 are assembled to ends of the housing 1 defining an U-shape receiving space between the housing 1 and the locking devices 3 thereby a card 4 can be securely held therein or removed therefrom after the locking devices 3 are neutralized.

Figure 2:
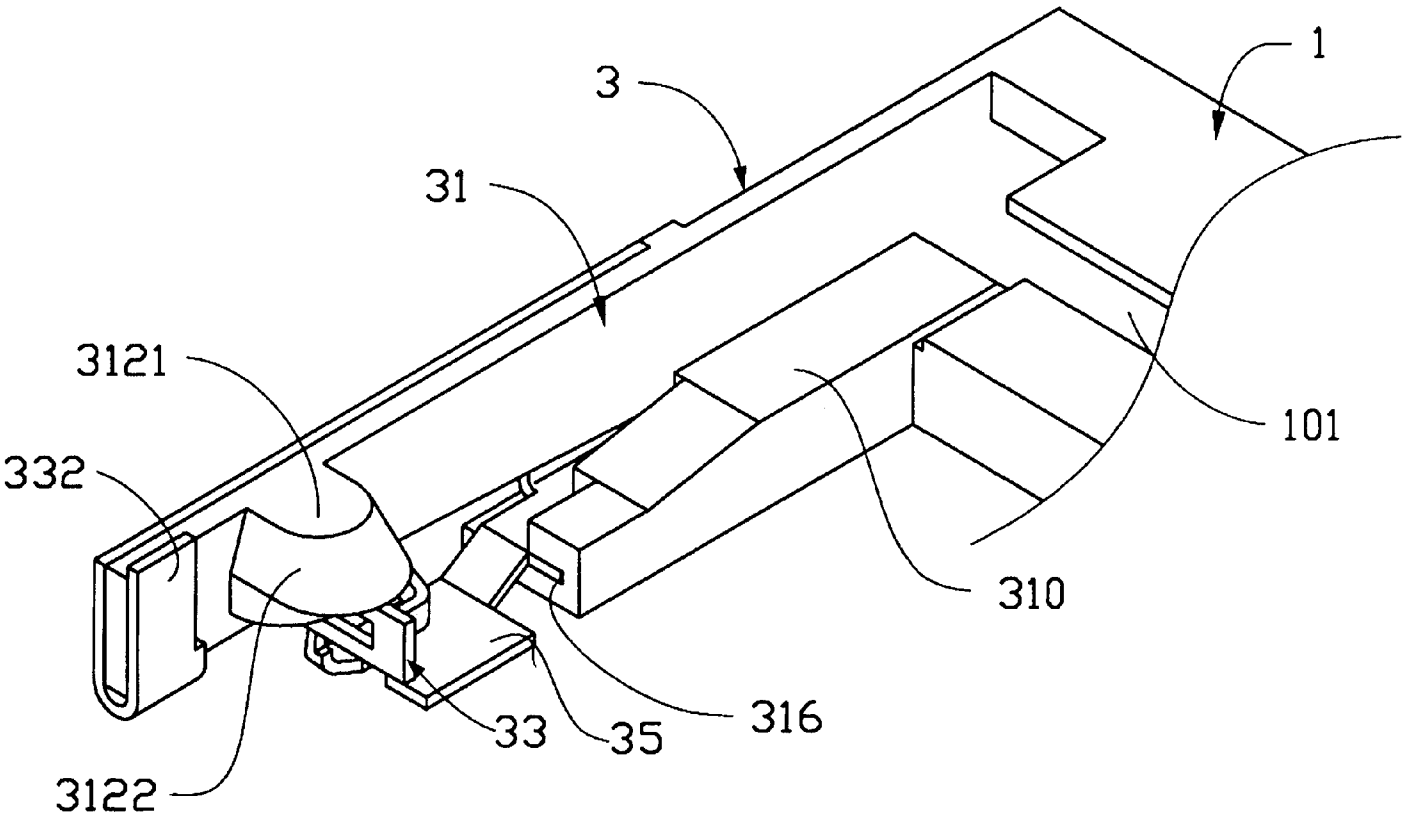
FIG. 2 is an enlarged view of a side of the connector of FIG. 1.
Figure 3:
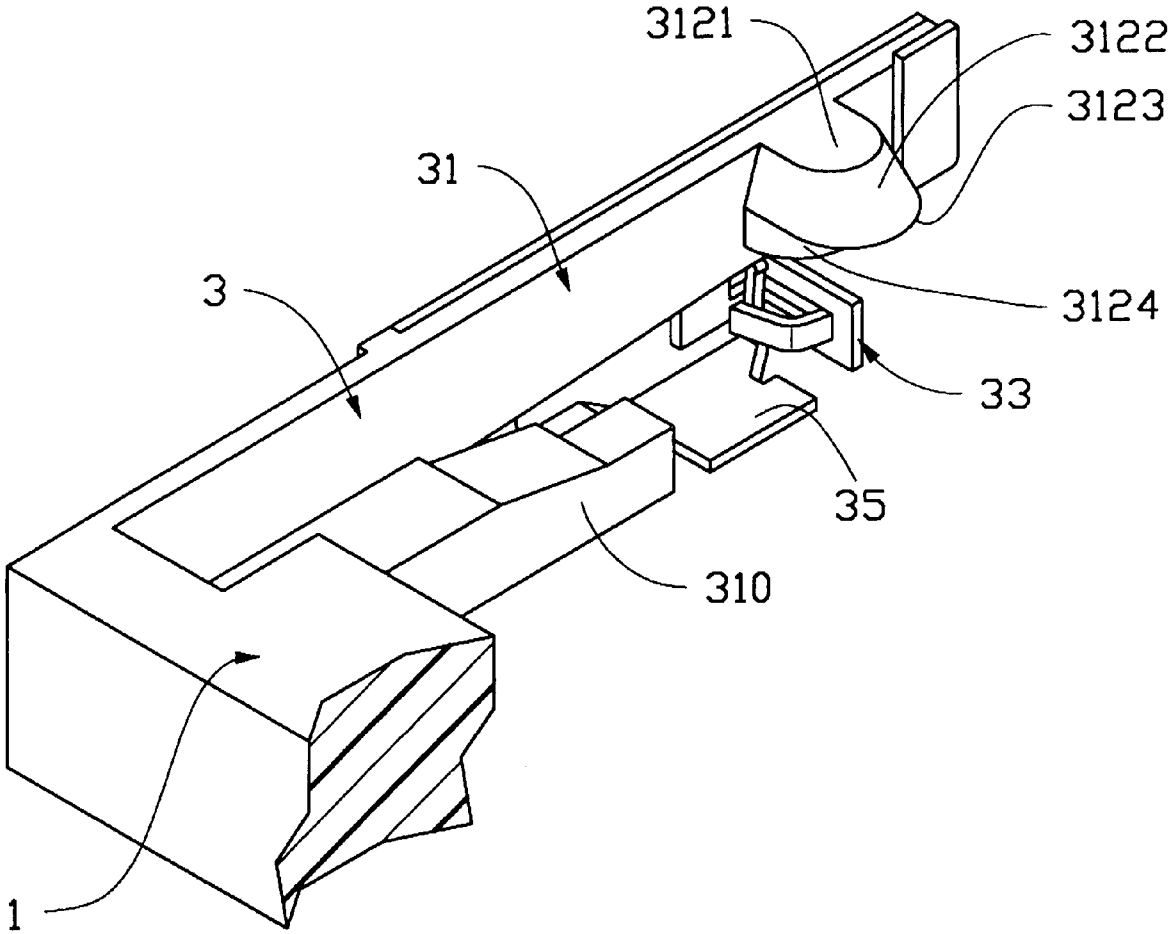
FIG. 3 is a reverse view of FIG. 2.

A Referring to FIGS. 2 and 3, the locking device 3 includes a locking arm 31, a releasing device 33, and an auxiliary positioning pad 35. The locking arm 31 extends from an end of the housing 1. A supporting arm 310 is integrally formed on an inner side of the locking arm 31 for supporting the inserted card 4 (FIG. 5). The supporting arm 310 defines a retaining slot 316 for retention of the releasing device 33 therein. A retaining embossment 3121 extends from the inner wall of the locking arm 31 for retaining the inserted card 4. The retaining embossment 3121 includes a guiding face 3122 for facilitating easy insertion of the card 4 and a retaining edge 3123 for holding the inserted card 4 in position. The retaining embossment 3121 further includes a shoulder 3124 which abuts against an edge of the inserted card 4.

Figure 4:
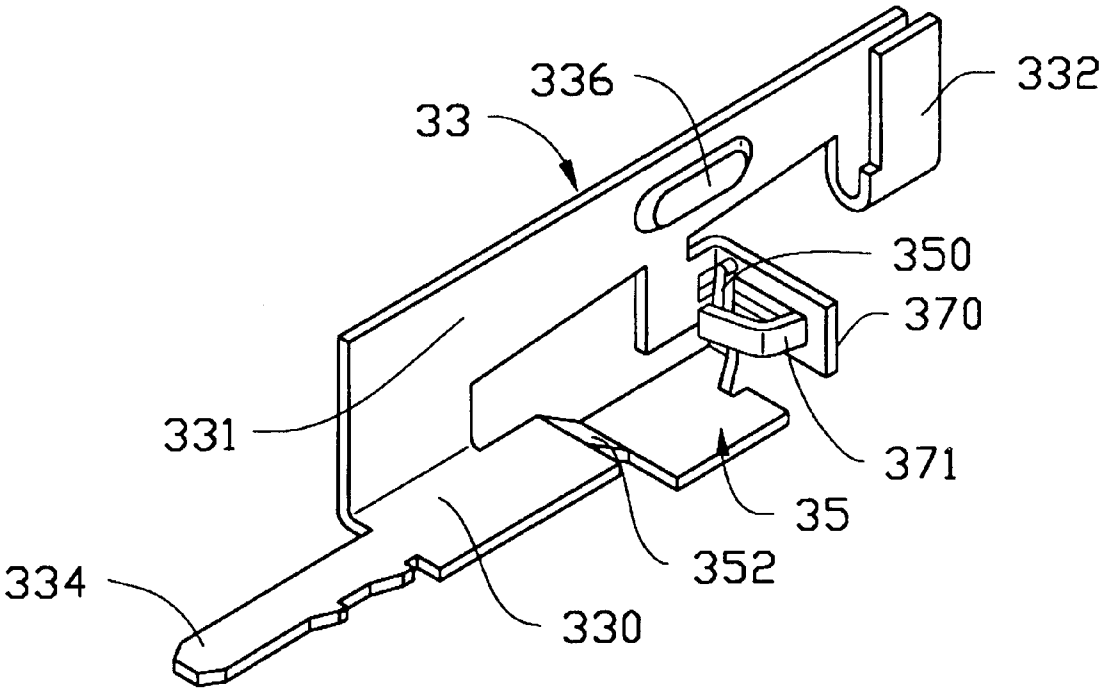
FIG. 4 is a perspective view of a releasing device of FIG. 1.

FIGS. 2 and 4 are a perspective view of the releasing device 33 which includes a base 330 and a resilient arm 331 extending from a side of the base 330. A U-shaped enclosure 332 is formed on an end of the resilient arm 331 for enveloping an end of the locking arm 31 when the releasing device 33 is assembled to the housing 1. A foot 334 extends from an end of the base 330 opposite the resilient arm 331 and which can be received within the retaining slot 316 formed on the end of the supporting arm 310. The base 330 further includes a positioning pad 35 extending from another end of the base 330 opposite the foot 334. An inclined portion 352 is located between the base 330 and the positioning pad 35. A limiting post 350 extends vertically from an end of the positioning pad 35. The resilient arm 331 forms a rib 336 projecting inward from an inner wall thereof. The width of the enclosure 332 is slightly larger than the thickness of the resilient arm 331 for easy assembly thereto. Nevertheless, this may generate a play between the resilient arm 331 and the enclosure 332. By the provision of the rib 336, the play therebetween will be eliminated.

An L-shaped tab 370 extends vertically from the resilient arm 331. The tab 370 forms a tongue 371 projecting toward the resilient arm 331. An inner wall of the tongue 371 abuts against the limiting post 350 thereby limiting over-movement of the resilient arm 331. The auxiliary positioning pad 35 is co-planar with the connecting face 11 of the housing 1 and is soldered to a conductive portion of a printed circuit board (not shown). This provides further support to the connector 9, especially during the soldering process and after the card 4 is inserted.

Figure 5A:
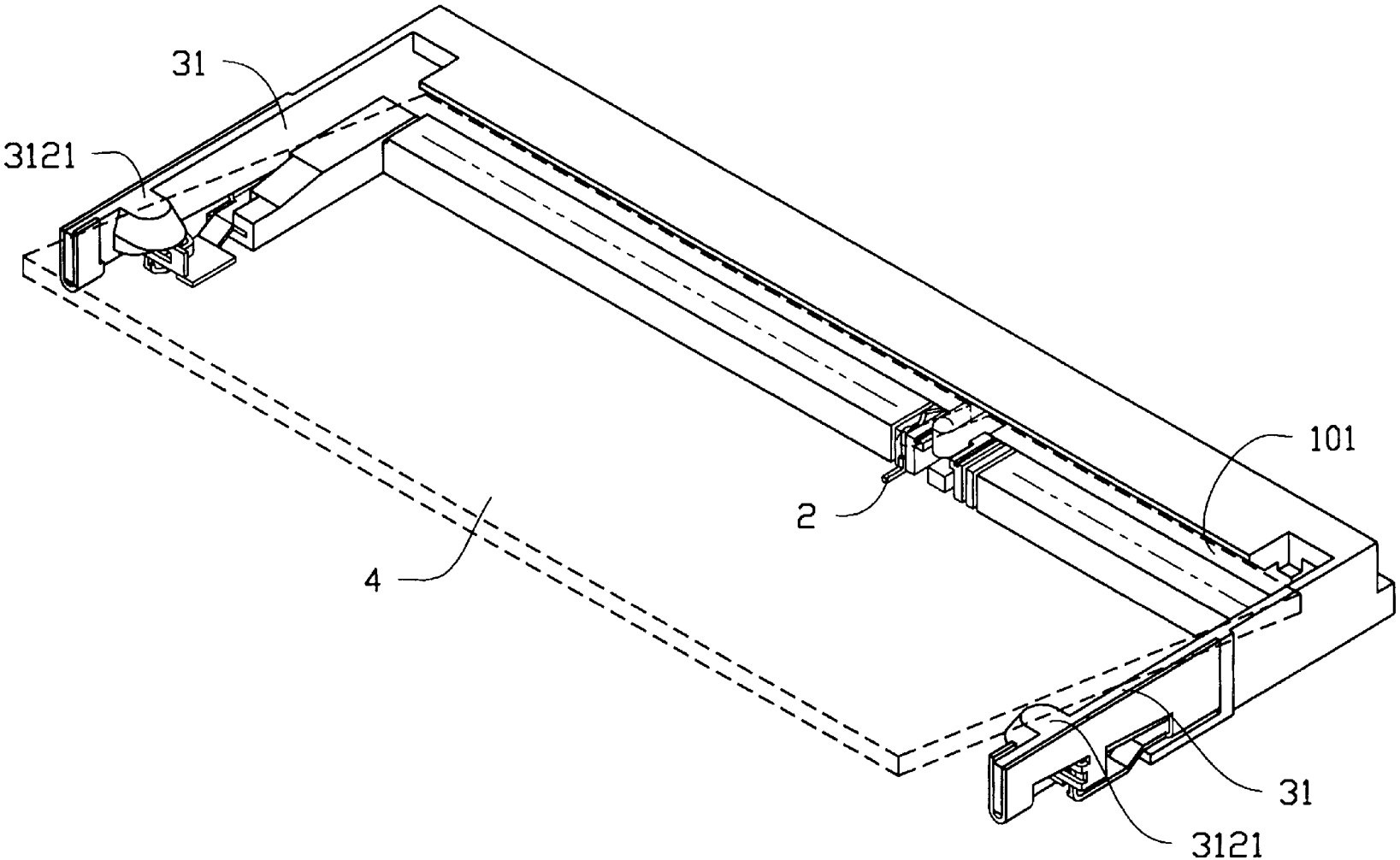
FIG. 5A is a perspective view of the connector having a memory module inserted therein.
Figure 5B:
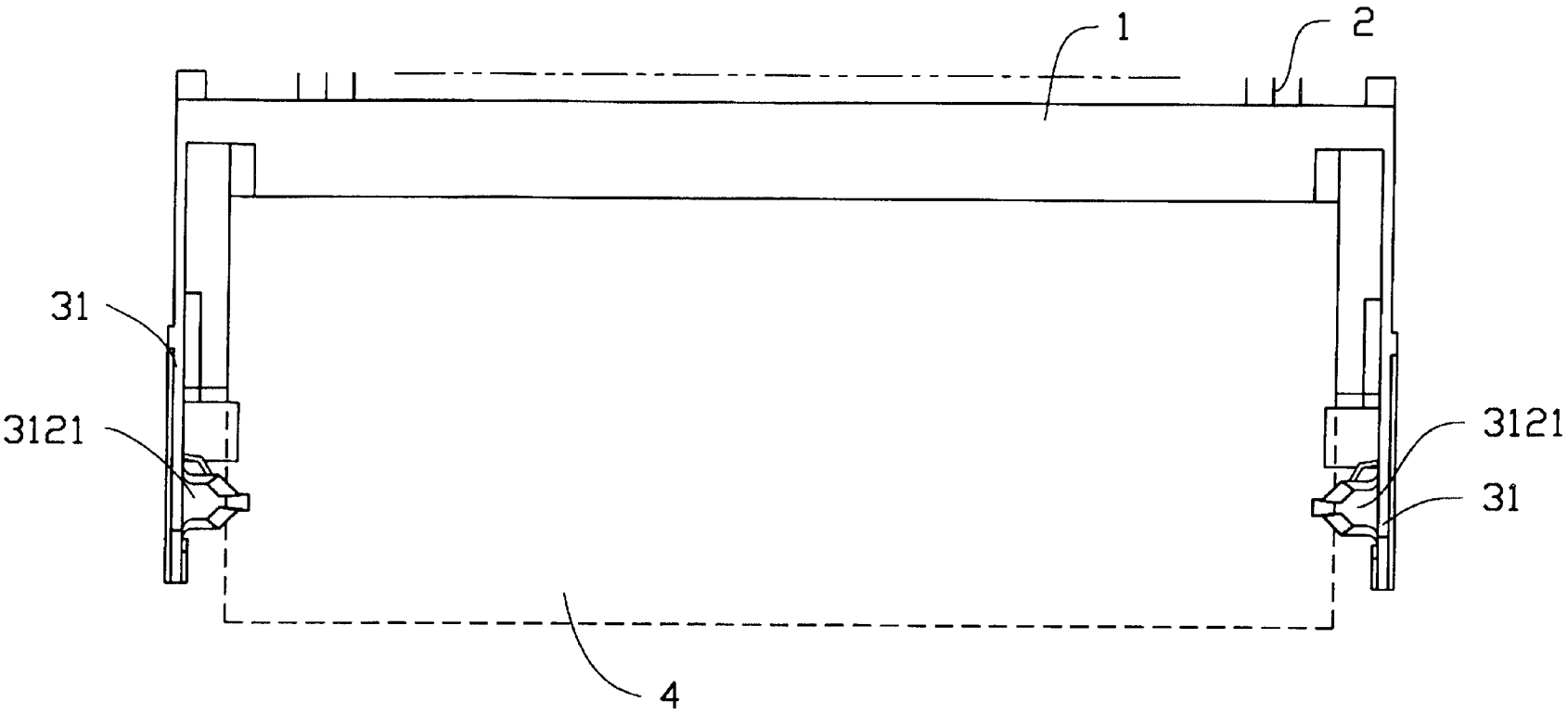
FIG. 5B is a top view of FIG. 5A.

Referring to FIGS. 5A, 5B and 3, in assembling the card 4 to the housing 1, a front edge of the card 4 is firstly inserted into the receiving slot 101 and side edges of the card 4 abut against the guiding face 3122 of the retaining embossment 3121. Then the enclosures 332 are moved away from each other whereby side edges of the card 4 slide over the retaining edge 3123 to the under face of the embossment 3121 and abutted by the shoulder 3124. When removing an inserted card 4, the enclosures 332 are moved apart again to release the inserted card 4 from the retaining edges 3123. Then the inserted card 4 can be conveniently removed therefrom.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims. Therefore, persons of ordinary skill in this field are to understand that all such equivalent structures are to be included within the scope of the following claims.

What is claimed is:

1. An electrical connector having a locking device, comprising:

a dielectric housing having a mating face and a connecting face, a receiving slot being defined along said mating face;

a plurality of terminals being assembled to said housing;

a pair of locking devices assembled to said housing and defining a receiving space with said housing, each locking device including:

a locking arm connected to each end of said housing, a supporting arm connected to the same end of said housing and defining a retaining slot therein, a retaining embossment extending from an inner wall of said locking arm toward said receiving space for receiving a card therein; and a releasing device assembled to each locking device for releasing said inserted card from said locking devices, said releasing device including a base and a resilient arm extending from a side of said base, a U-shaped enclosure formed on an end of said resilient arm for enveloping a free end of said locking are, a foot extending from said base being received within said retaining slot of said supporting arm; wherein said releasing device includes a positioning pad extending from said base and having a limiting post extending upward therefrom, said resilient arm including an L-shaped tab having a tongue abutting said limiting post thereby limiting movement of said locking arm.

2. The electrical connector as recited in claim 1, wherein an outer wall of said locking arm is flexibly supported by said resilient arm of said releasing device.

3. An electrical connector comprising:

a housing with a plurality of terminals therein;

at least one locking device positioned at one end of the housing and including a locking arm; and a releasing device assembled to the housing for cooperation with the locking device and including a stationary base and a deflectable resilient arm supportably abutting against the locking arm; wherein means for preventing prevent over-movement of the resilient arm are provided on the resilient arm and the base.

4. The connector as recited in claim 3, wherein said means includes a limiting post extending from a positioning pad of the base and a tongue extending from a tab of the resilient arm.

* * * * *